US010361506B2

(12) United States Patent
Faron et al.

(10) Patent No.: US 10,361,506 B2
(45) Date of Patent: Jul. 23, 2019

(54) ELECTRICAL CONNECTOR WITH A FIRST HOUSING SECURED IN A SECOND HOUSING

(71) Applicant: Delphi Technologies, LLC, Troy, MI (US)

(72) Inventors: Kamil Faron, Cracow (PL); Krzysztof Pitala, Mszana Dolna (PL); Marcin Zyromski, Cracow (PL); Michal Grudzewski, Cracow (PL)

(73) Assignee: DELPHI TECHNOLOGIES, LLC, Troy, MI (US)

( * ) Notice: Subject to any disclaimer, the term of this patent is extended or adjusted under 35 U.S.C. 154(b) by 2 days.

(21) Appl. No.: 15/953,618

(22) Filed: Apr. 16, 2018

(65) Prior Publication Data

US 2018/0316125 A1 Nov. 1, 2018

(30) Foreign Application Priority Data

Apr. 28, 2017 (EP) ..... 17168731

(51) Int. Cl.

| | |
|---|---|
| ***H01R 13/533*** | (2006.01) |
| ***H01R 13/506*** | (2006.01) |
| ***H01R 13/516*** | (2006.01) |
| ***H01R 13/627*** | (2006.01) |
| *H01R 33/975* | (2006.01) |

(52) U.S. Cl.

CPC ..... *H01R 13/533* (2013.01); *H01R 13/506* (2013.01); *H01R 13/516* (2013.01); *H01R 13/6272* (2013.01); *H01R 13/6271* (2013.01); *H01R 13/6275* (2013.01); *H01R 33/975* (2013.01)

(58) Field of Classification Search

CPC ..... H01R 33/975; H01R 13/533; H01R 13/6271; H01R 13/6275

USPC ..... 439/358, 382

See application file for complete search history.

(56) References Cited

U.S. PATENT DOCUMENTS 5,989,072 A 11/1999 Hickox et al.
7,214,080 B2 * 5/2007 Ichio ..... H01R 13/6272 439/246

(Continued)

FOREIGN PATENT DOCUMENTS

WO 2010015641 A1 2/2010

*Primary Examiner* — Abdullah A Riyami
*Assistant Examiner* — Justin M Kratt
(74) *Attorney, Agent, or Firm* — Robert J. Myers

(57) ABSTRACT

An electrical connector includes a first connector housing having a cavity aligned along a mating axis and configured to receive an electrical terminal. The first connector housing has a first holding device protruding outwardly from an outer surface of the first connector housing. The electrical connector also includes a second connector housing surrounding the first connector housing along the mating axis. The second connector housing has a second holding device protruding inwardly from an inner surface of the second connector housing. The first holding device includes a first blocking surface and the second holding device includes a second blocking surface. The first blocking surface is arranged opposite the second blocking surface. The first and second holding device cooperate with each other to press the first blocking surface to the second blocking surface while holding the first and second connector housings tightly together.

16 Claims, 5 Drawing Sheets

(56) References Cited

U.S. PATENT DOCUMENTS

| | | | |
|---|---|---|---|
| 8,257,111 | B1 | 9/2012 | Smutny et al. |
| 2011/0053408 | A1 | 3/2011 | Tsuruta et al. |

* cited by examiner

ELECTRICAL CONNECTOR WITH A FIRST HOUSING SECURED IN A SECOND HOUSING

CROSS-REFERENCE TO RELATED APPLICATION

This application claims the benefit under 35 U.S.C. § 119(a) of Patent Application No. 17168731.2 filed in the European Patent Office on Apr. 28, 2017, the entire disclosure of which is hereby incorporated by reference.

TECHNICAL FIELD OF THE INVENTION

The present invention relates to an electrical connector.

BRIEF DESCRIPTION OF THE SEVERAL VIEWS OF THE DRAWING

The present invention will now be described, by way of example with reference to the accompanying drawings, in which.

DETAILED DESCRIPTION OF THE INVENTION

Figure 4:
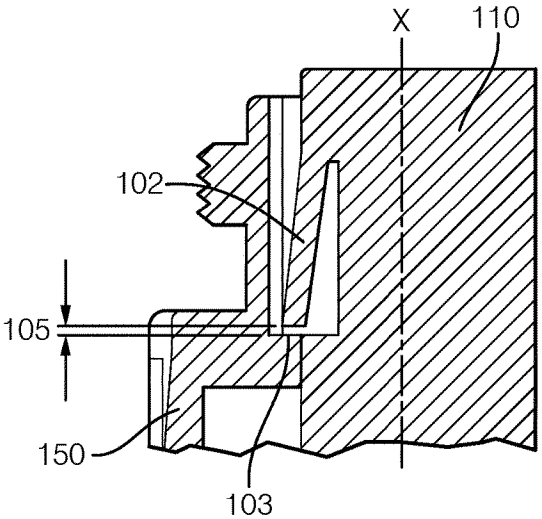
FIG. 4 PRIOR ART
FIG. 4 shows a cross section view of the electrical connector according to the prior art.

An electrical connector is presented herein.

In one embodiment, the electrical connector includes a first connector housing having a cavity aligned along a mating axis that is configured to receive an electrical terminal. The first connector housing includes a first holding device that protrudes perpendicularly to the mating axis outwardly from an outer surface of the first connector housing. The electrical connector further includes a second connector housing surrounding the first connector housing along the mating axis. The second connector housing includes a second holding device that protrudes perpendicularly to the mating axis inwardly from an inner surface of the second connector housing. The first holding device has a first blocking surface extending perpendicular to the mating axis. The second holding device has a second blocking surface extending perpendicular to the mating axis. The first blocking surface is arranged opposite the second blocking surface. The first holding device and the second holding device cooperate with each other to press the first blocking surface to the second blocking surface while holding the first connector housing and the second connector housing tightly together.

Without subscribing to any particular theory of operation, the electrical connector uses the flexibility of the surrounding cover to press continuously the protrusion that is attached on the surrounding cover against the slopes area attached on the inner connector housing. As the surrounding cover is urged from being in flexed state to being in relax state, the surrounding cover protrusion slides in the direction that causes less stress to the surrounding cover. In this embodiment, the surrounding cover protrusion is urged towards the inner connector housing, thereby moving the surrounding cover along the mating axis until the blocking surfaces are in contact. This arrangement acts as a spring that forces the two parts together. The electrical connector acts then like a one piece body and is robust against vibration. Because the blocking surfaces can be used also as sealing surfaces, it is possible to provide a complete sealed electrical connector. The terms "outer surface" and "inner surface" are used herein to distinguish the protruding parts, as explained, from other protrusions protruding from other surfaces.

In one embodiment, the first blocking surface and the second blocking surface extend partly around the mating axis. If sealing issues do not have to be considered, a two-part connector without mechanical play between the first and second connector housings can be realized with little effort.

The first blocking surface and the second blocking surface may extend fully around the mating axis. If sealing issues are to be considered, a freely sealed two-part connector can be provided by completely surrounding blocking surfaces.

In one embodiment, the first holding device includes an inclined first protrusion having a plane first bearing surface. The plane first bearing surface is spaced apart from the first blocking surface along the mating axis. This design provides a recess that can receive, at least partly, the rib shaped second protrusion. These features provide a connector design with a reduced cross-section.

The plane first bearing surface and the first blocking surface may be arranged opposite to each other defining a wedge angle smaller than 90°. In practice the wedge angle may be chosen to be around 45°, because it is a good compromise to use the function of flexibility and inclined surface. A small wedge angle needs more flexibility of the surrounding cover while improving the pressure on the blocking surfaces and vice versa for a greater wedge angle. The application determines the wedge angle.

The plane first bearing surface may extend from the outer surface of the first connector housing until an outer end of the inclined first protrusion.

The second holding device may include a rib shaped second protrusion extending a rib length along the mating axis and having a first rib end and a second rib end spaced apart along the mating axis. This design provides a holding device that is easy to manufacture. A sloped rib shaped second protrusion sloped by an angle (about 5-10°) in relation to the mating axis allows easy mounting of first and second connector housings.

The first rib end may have a second bearing surface. The second rib end includes the second blocking surface.

In one embodiment, the second bearing surface extends from the inner surface of the second connector housing and is arc shaped. The arc shape improves the sliding properties while cooperating with the plane first bearing surface.

The second bearing surface may contact the plane first bearing surface in a region between the outer surface of the first connector housing and the outer end of the inclined first protrusion. This design allows a flexible movement after two connector parts in relation to each other.

The second connector housing may be sleeve shaped and flexibly deformable. The second connector housings flexibility can be configured to the required behavior of the connector. The second connector housing can be made of different materials with different properties. The first and second connector housings may be formed of standard plastic materials for connector housings.

The second connector housing may have a rectangular cross section surrounding the mating axis. The second holding device is arranged on a plane portion between two corners. One protrusion on the straight wall can flex very smoothly dependent on the length of the wall and also on the thickness of the wall. The flexibility can be adjusted to the application by this parameters.

The second connector housing may be flexibly deformed outwards the mating axis by the inclined first protrusion and the rib shaped second protrusion cooperating with each other. The connector is continuously kept together in assembled state.

Figure 5:
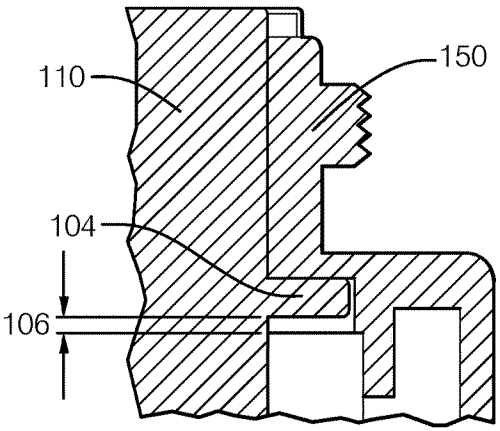
FIG. 5 PRIOR ART
FIG. 5 shows a cross section view of the electrical connector according to the prior art.
Figure 2:
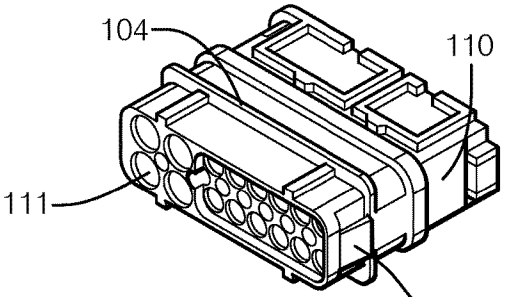
FIG. 2 PRIOR ART
FIG. 2 shows a perspective view of a first connector housing of the electrical connector according to the prior art.
Figure 1:
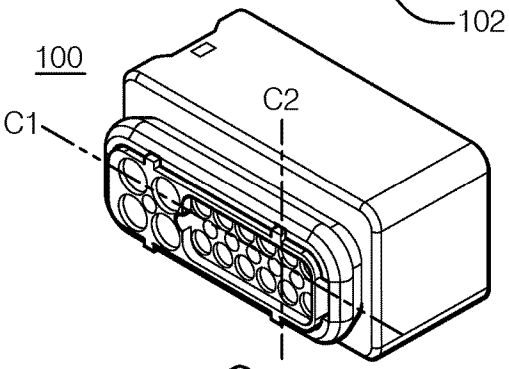
FIG. 1 PRIOR ART
FIG. 1 shows a perspective view of an electrical connector according to the prior art.
Figure 3:
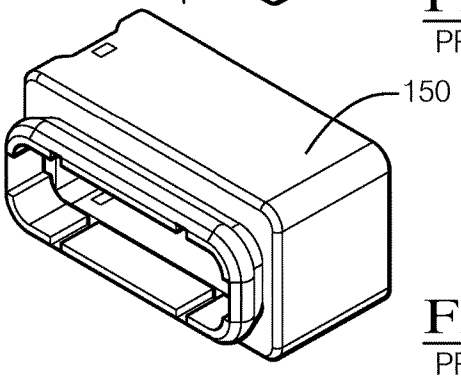
FIG. 3 PRIOR ART
FIG. 3 shows a perspective view of a second housing of the electrical connector according to the prior art.

FIG. 1 shows a perspective view of an electrical connector 100 known in the art. The electrical connector 100 includes a second connector housing 150 (see FIG. 3) and a first connector housing 110 (see FIG. 2). The first connector housing 110 includes a cavity 111 configured to carry an electrical contact. The first connector housing 110 has a flexible locking arm 102 protruding in an angle from the first connector housing 110 that is configured to cooperate with a blocking edge 103 provided in the second connector housing 150. The first connector housing 110 also has a blocking rib 104 protruding perpendicular to the mating axis X. FIG. 4 shows a cross section of the electrical connector 100. The sectioning is carried out along the cut line C1 along the mating axis X. The flexible locking arm 102 is flexed outwards configured to cooperate with the blocking edge 103 of the second connector housing 150. The flexible locking arm 102 needs a clearance 105 to be movable while assembling the first connector housing 110 and the second connector housing 150. FIG. 5 shows a cross section view of the electrical connector 100. The sectioning is carried out along the cut line C2 along the mating axis X. The design of the electrical connector 1 provides a second clearance 106 to allow movement of the blocking rib 104 along the mating axis X as it is necessary for the working principle of the flexible locking arm 102.

Figure 6:
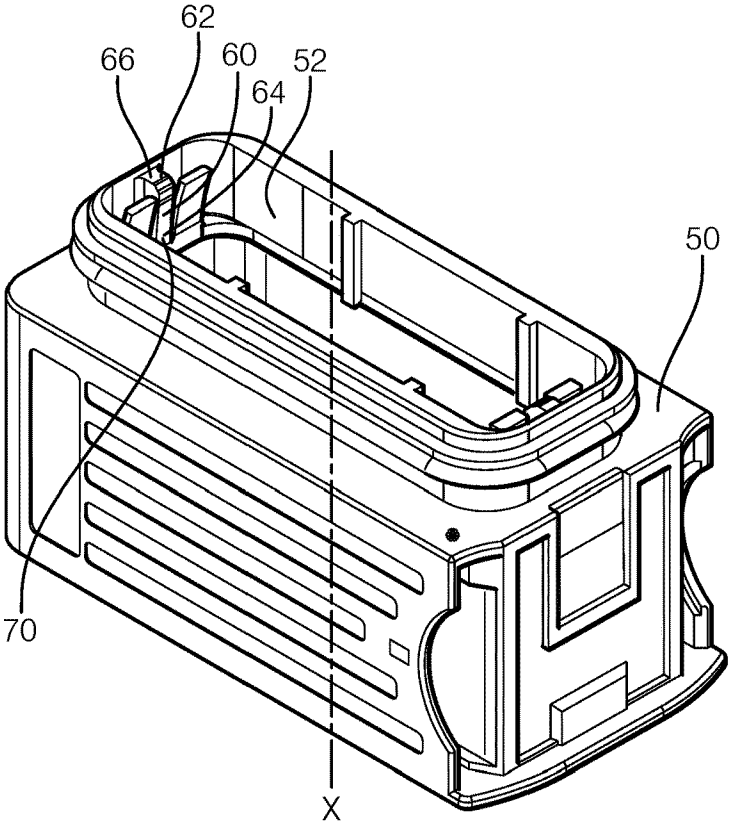
FIG. 6 shows a perspective view of a second connector housing of an electrical connector in accordance with an embodiment of the invention.
Figure 8:
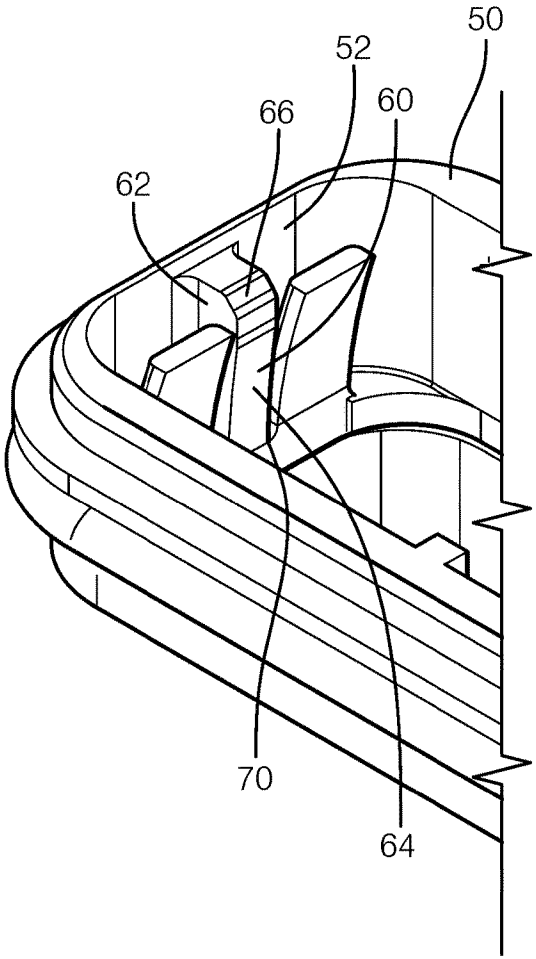
FIG. 8 shows a perspective view of details of the second connector housing in accordance with an embodiment of the invention.

FIGS. 6 and 8 show a perspective view of a second connector housing 50 in accordance with the present invention. The second connector housing 50 includes second holding device protruding inwardly perpendicular to the mating axis X from an inner surface 52 of the second connector housing 50. The second holding device includes a rib shaped second protrusion 60 extending along the mating axis X having a first rib end 62 and a second rib end 64 spaced apart along the mating axis X. The first rib end 62 includes a second bearing surface 66 and the second rib end 64 includes a second blocking surface 70. The second blocking surface 70 (see FIG. 11) extending perpendicular to the mating axis X. The second bearing surface 66 extending from the inner surface 52 of the second connector housing 50 is arc shaped. The second connector housing 50 has a rectangular cross section surrounding the mating axis X and the rib shaped second protrusion 60 is arranged on a plane portion between two corners. FIG. 8 shows an enlarged view of the features described above.

Figure 7:
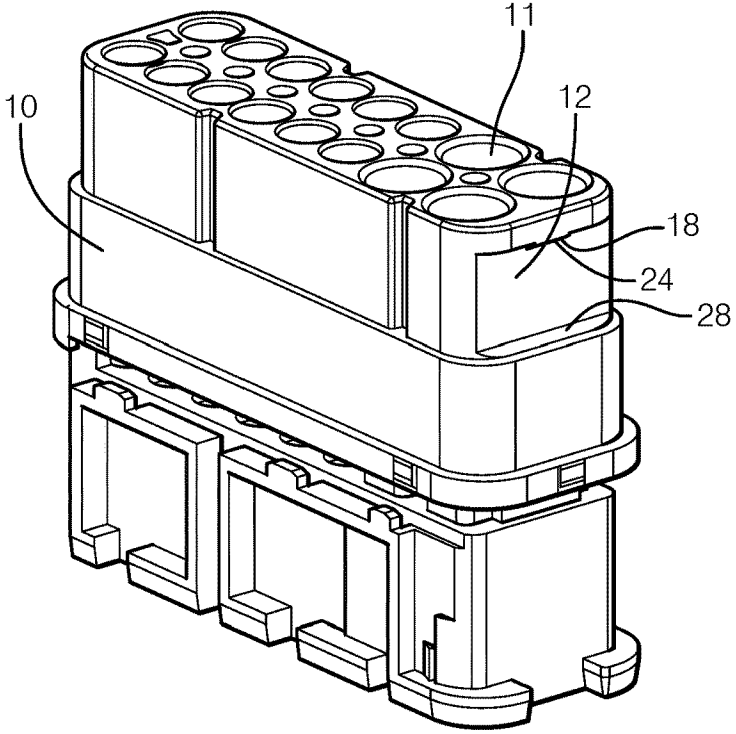
FIG. 7 shows a perspective view of a first connector housing of an electrical connector in accordance with an embodiment of the invention.
Figure 9:
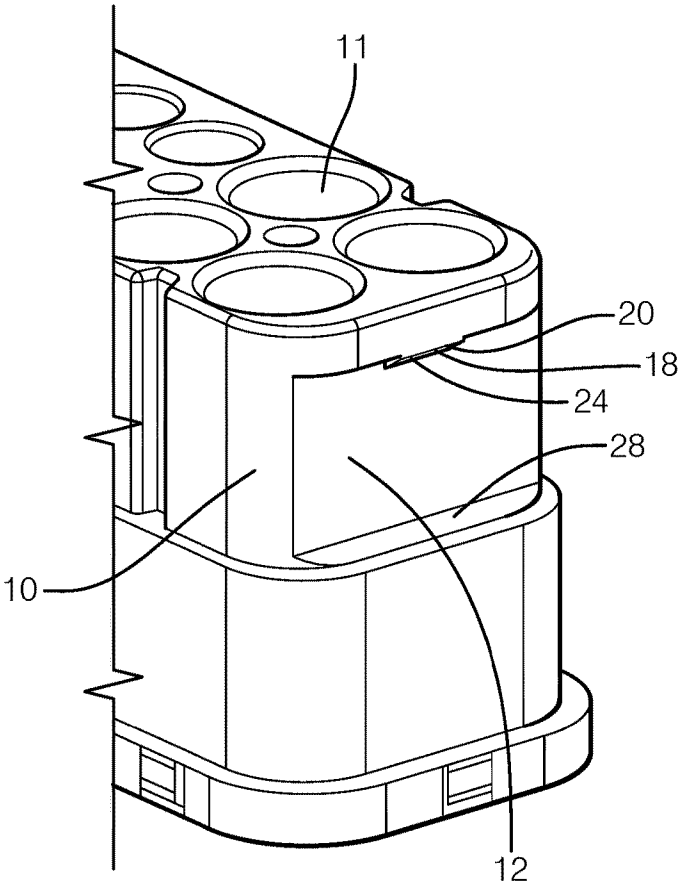
FIG. 9 shows a perspective view of details of the first connector housing in accordance with an embodiment of the invention.

FIGS. 7 and 9 show perspective views of a first connector housing 10 of the electrical connector 1 in accordance with the present invention. The first connector housing 10 includes a cavity 11 aligned along the mating axis X that is configured to receive an electrical terminal. The first connector housing 10 includes first holding device, protruding outwardly perpendicular to the mating axis X, from an outer surface 12 of the first connector housing 10. The first holding device includes a first blocking surface 28 extending perpendicular to the mating axis X. The first holding device includes an inclined first protrusion 18 including a plane first bearing surface 24. The plane first bearing surface 24 is spaced apart from the first blocking surface 28 along the mating axis X. The plane first bearing surface 24 and the first blocking surface 28 are arranged opposite to each other. FIG. 9 shows an enlarged view of the features described above.

Figure 10:
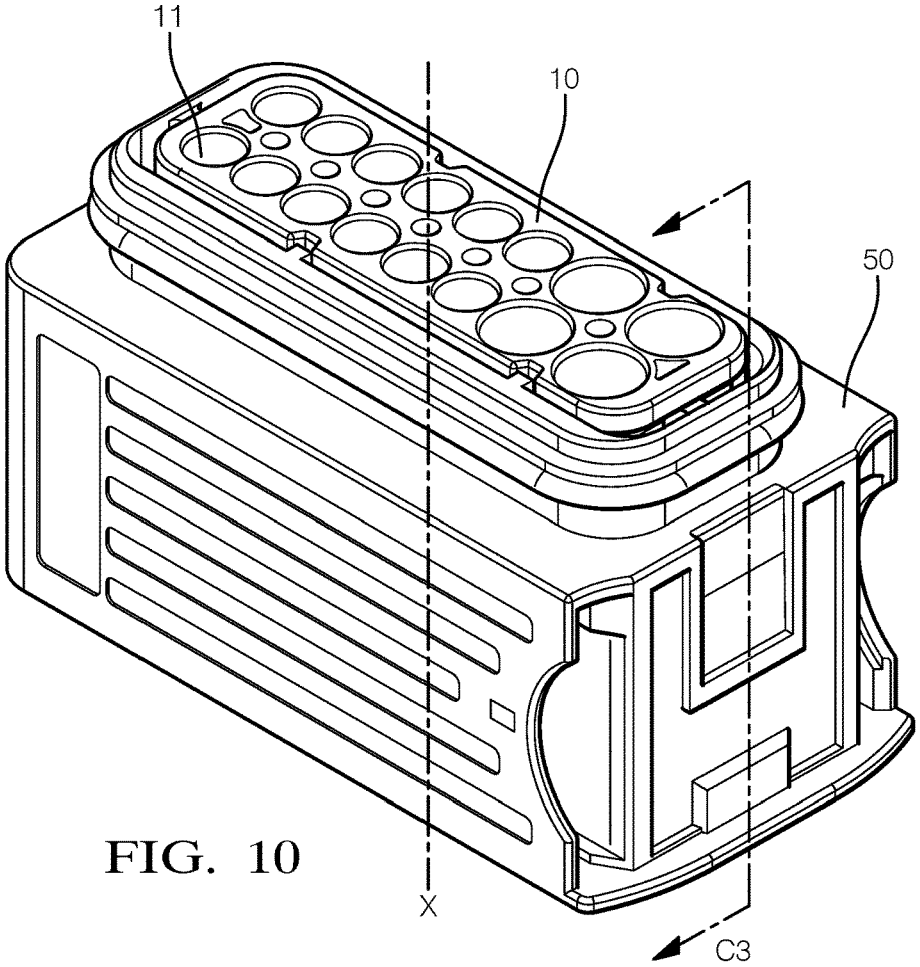
FIG. 10 shows a perspective view of an electrical connector in accordance with an embodiment of the invention.

FIG. 10 shows a perspective view of the electrical connector 1 in accordance with the present invention. The second connector housing 50 surrounding the first connector housing 10 along the mating axis X.

Figure 11:
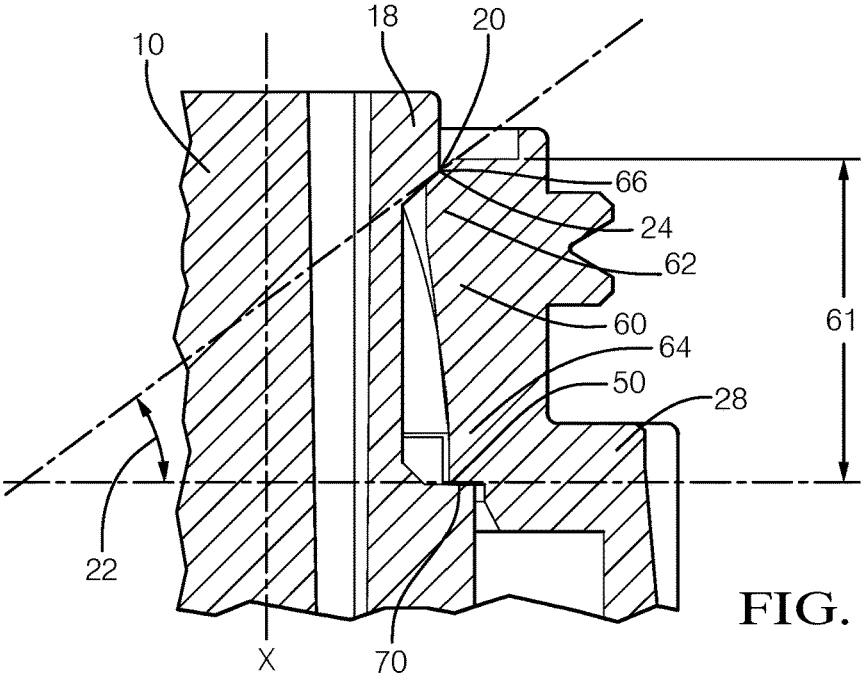
FIG. 11 shows a cross section of the electrical connector in accordance with an embodiment of the invention.
Figure 12:
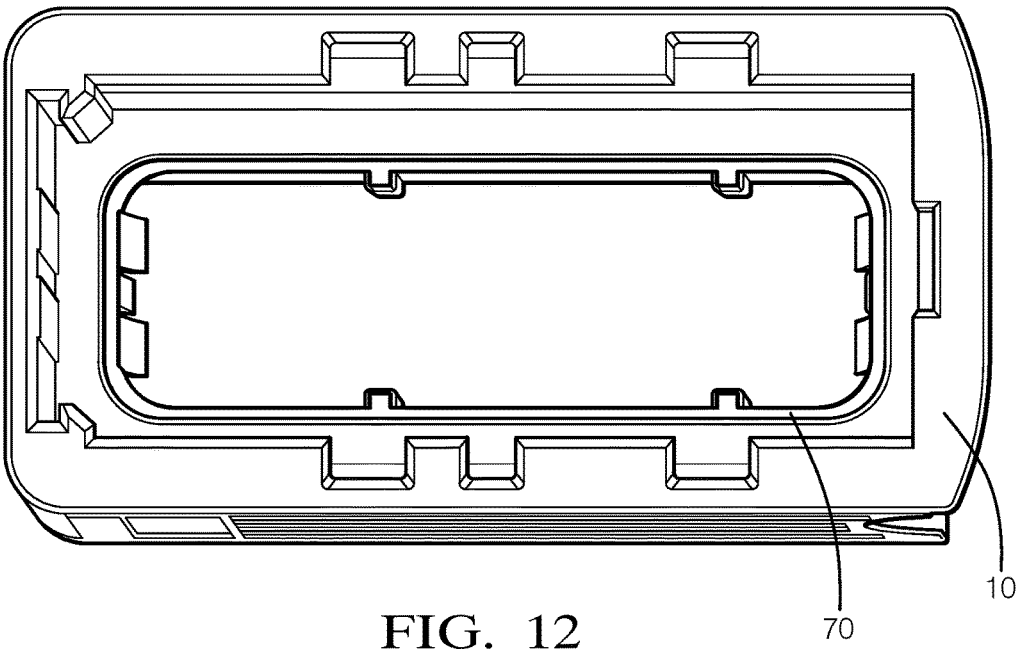
FIG. 12 shows an end view of a first connector housing of an electrical connector in accordance with an embodiment of the invention.
Figure 13:
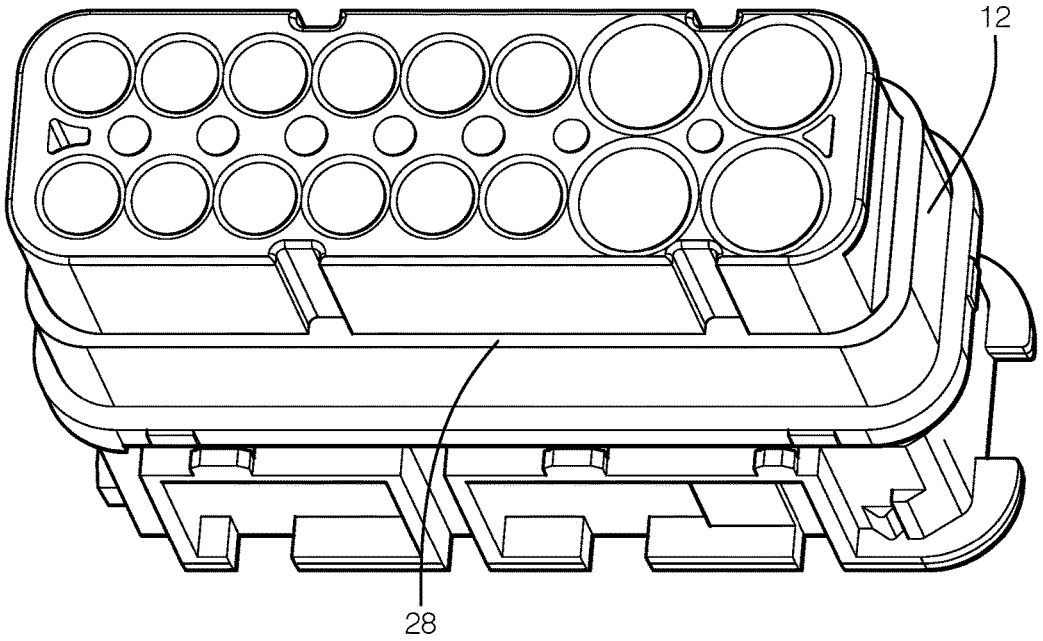
FIG. 13 shows an end view of a second connector housing of an electrical connector in accordance with an embodiment of the invention.

FIG. 11 shows a cross section view of the electrical connector 1 shown in FIG. 10. The sectioning is carried out along the cut line C3 in a direction perpendicular to the mating axis X. The plane first bearing surface 24 and the first blocking surface 28 are arranged opposite to each other. The first holding device and the second holding device cooperate with each other to press the first blocking surface 28 to the second blocking surface 70 while holding the first connector housing 10 and the second connector housing 50 tightly together. The plane first bearing surface 24 and the first blocking surface 28 are arranged opposite to each other defining a wedge angle 22 smaller than 90°. The plane first bearing surface 24 extends from the outer surface 12 of the first connector housing 10 until an outer end 20 of the inclined first protrusion 18. The second holding device includes a rib shaped second protrusion 60 extending a rib length 61 along the mating axis X having a first rib end 62 and a second rib end 64 spaced apart along the mating axis X. The second bearing surface 66 contacts the plane first bearing surface 24 in a region between the outer surface 12 of the first connector housing 10 and the outer end 20 of the inclined first protrusion 18. In this embodiment the rib length 61 is larger than the distance between the first blocking surface 28 and the outer end 20 of the inclined first protrusion 18. In other embodiments the rib length 61 can be smaller than the distance between the first blocking surface 28 and the outer end 20 of the inclined first protrusion 18.

While this invention has been described in terms of the preferred embodiments thereof, it is not intended to be so limited, but rather only to the extent set forth in the claims that follow. For example, the above-described embodiments (and/or aspects thereof) may be used in combination with each other. In addition, many modifications may be made to configure a particular situation or material to the teachings of the invention without departing from its scope. Dimensions, types of materials, orientations of the various components, and the number and positions of the various components described herein are intended to define parameters of certain embodiments, and are by no means limiting and are merely prototypical embodiments.

Many other embodiments and modifications within the spirit and scope of the claims will be apparent to those of skill in the art upon reviewing the above description. The scope of the invention should, therefore, be determined with reference to the following claims, along with the full scope of equivalents to which such claims are entitled.

As used herein, 'One or more' includes a function being performed by one element, a function being performed by more than one element, e.g., in a distributed fashion, several functions being performed by one element, several functions being performed by several elements, or any combination of the above.

The terminology used in the description of the various described embodiments herein is for the purpose of describing particular embodiments only and is not intended to be limiting. As used in the description of the various described embodiments and the appended claims, the singular forms "a", "an" and "the" are intended to include the plural forms as well, unless the context clearly indicates otherwise. It will also be understood that the term "and/or" as used herein refers to and encompasses any and all possible combinations of one or more of the associated listed items. It will be further understood that the terms "includes," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof.

That while terms of ordinance or orientation may be used herein these elements should not be limited by these terms. All terms of ordinance or orientation, unless stated otherwise, are used for purposes distinguishing one element from another, and do not denote any particular order, order of operations, direction or orientation unless stated otherwise.

We claim:

1. An electrical connector, comprising:

a first connector housing, having a cavity aligned along a mating axis configured to receive an electrical terminal, wherein the first connector housing includes a first holding means protruding perpendicularly to the mating axis outwardly from an outer surface of the first connector housing;

a second connector housing surrounding the first connector housing along the mating axis, wherein the second connector housing includes a second holding means protruding perpendicularly to the mating axis inwardly from an inner surface of the second connector housing, wherein the first holding means includes a first blocking surface extending perpendicularly to the mating axis, wherein the second holding means includes a second blocking surface extending perpendicularly to the mating axis, wherein the first blocking surface is arranged opposite the second blocking surface, wherein the first blocking surface and the second blocking surface extend fully around the mating axis, and wherein the first holding means and the second holding means cooperate with each other to press the first blocking surface to the second blocking surface while holding the first connector housing and the second connector housing tightly together.

2. The electrical connector according to claim 1, wherein the first holding means includes an inclined first protrusion having a plane first bearing surface, wherein the plane first bearing surface is spaced apart from the first blocking surface along the mating axis.

3. The electrical connector according to claim 2, wherein the plane first bearing surface and the first blocking surface are arranged opposite to each other defining a wedge angle smaller than 90°.

4. The electrical connector according to claim 2, wherein the plane first bearing surface extends from the outer surface of the first connector housing until an outer end of the inclined first protrusion.

5. The electrical connector according to claim 4, wherein the second holding means comprises a rib shaped second protrusion extending a rib length along the mating axis having a first rib end and a second rib end spaced apart along the mating axis.

6. The electrical connector according to claim 5, wherein the first rib end comprises a second bearing surface and wherein the second rib end comprises the second blocking surface.

7. The electrical connector according to claim 6, wherein the second bearing surface extending from the inner surface of the second connector housing is arc shaped.

8. The electrical connector according to claim 7, wherein the second bearing surface contacts the plane first bearing surface in a region between the outer surface of the first connector housing and the outer end of the inclined first protrusion.

9. The electrical connector according to claim 1, wherein the second connector housing is sleeve shaped and flexibly deformable.

10. An electrical harness, comprising:

the electrical connector according to claim 1; and an electrical wire with attached electrical terminal inserted in the cavity.

11. An electrical connector, comprising:

a first connector housing, having a cavity aligned along a mating axis configured to receive an electrical terminal, wherein the first connector housing includes a first holding means protruding perpendicularly to the mating axis outwardly from an outer surface of the first connector housing;

a second connector housing surrounding the first connector housing along the mating axis, wherein the second connector housing includes a second holding means protruding perpendicularly to the mating axis inwardly from an inner surface of the second connector housing, wherein the first holding means includes a first blocking surface extending perpendicularly to the mating axis, wherein the second holding means includes a second blocking surface extending perpendicularly to the mating axis, wherein the first blocking surface is arranged opposite the second blocking surface, wherein the first holding means and the second holding means cooperate with each other to press the first blocking surface to the second blocking surface while holding the first connector housing and the second connector housing tightly together, wherein the first holding means includes an inclined first protrusion having a plane first bearing surface, wherein the plane first bearing surface is spaced apart from the first blocking surface along the mating axis, wherein the plane first bearing surface extends from the outer surface of the first connector housing until an outer end of the inclined first protrusion, wherein the second holding means comprises a rib shaped second protrusion extending a rib length along the mating axis having a first rib end and a second rib end spaced apart along the mating axis, and wherein the rib length is smaller than a distance between the first blocking surface and the outer end of the inclined first protrusion.

12. An electrical harness, comprising:

the electrical connector according to claim 11; and an electrical wire with attached electrical terminal inserted in the cavity.

13. An electrical connector, comprising:

a first connector housing, having a cavity aligned along a mating axis configured to receive an electrical terminal, wherein the first connector housing includes a first holding means protruding perpendicularly to the mating axis outwardly from an outer surface of the first connector housing;

a second connector housing surrounding the first connector housing along the mating axis, wherein the second connector housing includes a second holding means protruding perpendicularly to the mating axis inwardly from an inner surface of the second connector housing, wherein the first holding means includes a first blocking surface extending perpendicularly to the mating axis, wherein the second holding means includes a second blocking surface extending perpendicularly to the mating axis, wherein the first blocking surface is arranged opposite the second blocking surface, wherein the first holding means and the second holding means cooperate with each other to press the first blocking surface to the second blocking surface while holding the first connector housing and the second connector housing tightly together, wherein the first holding means includes an inclined first protrusion having a plane first bearing surface, wherein the plane first bearing surface is spaced apart from the first blocking surface along the mating axis, wherein the plane first bearing surface extends from the outer surface of the first connector housing until an outer end of the inclined first protrusion, wherein the second holding means comprises a rib shaped second protrusion extending a rib length along the mating axis having a first rib end and a second rib end spaced apart along the mating axis, and wherein the second connector housing is flexibly deformed outwardly of the mating axis by the inclined first protrusion and the rib shaped second protrusion cooperating with each other.

14. The electrical connector according to claim 13, wherein the second connector housing has a rectangular cross section surrounding the mating axis and wherein the second holding means is arranged on a plane portion between two corners.

15. An electrical harness, comprising:

the electrical connector according to claim 13; and an electrical wire with attached electrical terminal inserted in the cavity.

16. An electrical connector, comprising:

a first connector housing, having a cavity aligned along a mating axis configured to receive an electrical terminal, wherein the first connector housing includes a first holding means protruding perpendicularly to the mating axis outwardly from an outer surface of the first connector housing;

a second connector housing surrounding the first connector housing along the mating axis, wherein the second connector housing includes a second holding means protruding perpendicularly to the mating axis inwardly from an inner surface of the second connector housing, wherein the first holding means includes a first blocking surface extending perpendicularly to the mating axis, wherein the second holding means includes a second blocking surface extending perpendicularly to the mating axis, wherein the first blocking surface is arranged opposite the second blocking surface, and wherein the first holding means and the second holding means cooperate with each other to press the first blocking surface to the second blocking surface while holding the first connector housing and the second connector housing tightly together, wherein the first holding means includes an inclined first protrusion having a plane first bearing surface, wherein the plane first bearing surface is spaced apart from the first blocking surface along the mating axis, wherein the second holding means comprises a rib shaped second protrusion extending a rib length along the mating axis having a first rib end and a second rib end spaced apart along the mating axis and wherein the second connector housing is flexibly deformed outwardly of the mating axis by the inclined first protrusion and the rib shaped second protrusion cooperating with each other.

* * * * *